US005297631A

United States Patent [19]

Gipson

[11] Patent Number: 5,297,631

[45] Date of Patent: Mar. 29, 1994

[54] METHOD AND APPARATUS FOR DOWNHOLE OIL WELL PRODUCTION STIMULATION

[75] Inventor: Thomas C. Gipson, Cisco, Tex.

[73] Assignee: Fleet Cementers, Inc., Cisco, Tex.

[21] Appl. No.: 44,187

[22] Filed: Apr. 7, 1993

[51] Int. Cl.[5] ..... E21B 43/00

[52] U.S. Cl. ..... 166/299; 166/63; 166/305.1

[58] Field of Search ..... 166/305.1, 307, 63, 166/177, 299

[56] References Cited

U.S. PATENT DOCUMENTS 3,702,635 11/1972 Farr ..... 166/300 X 3,965,983 6/1976 Watson ..... 166/64 X 4,408,676 10/1983 McCoy ..... 155/255 X

*Primary Examiner*—William P. Neuder

*Attorney, Agent, or Firm*—Gunn, Lee & Miller

[57] ABSTRACT

A method and apparatus for stimulating the production zone of an oil well having a high pressure gas gun and a coil tubing conduit to deliver cleaning, stimulating, and cooling liquid to the zone while firing the gun. The coil tubing conduit has discharge ports positioned to allow discharge of the liquid at or near the gun to provide cooling of the gun's electrical transmission line and the gun's moving parts. The gun may be gradually withdrawn from the production zone while continuing to fire the gun to stimulate the production zone.

8 Claims, 2 Drawing Sheets

METHOD AND APPARATUS FOR DOWNHOLE OIL WELL PRODUCTION STIMULATION

BACKGROUND OF THE INVENTION

The present invention relates to oil well production and, more particularly, to a method and apparatus for downhole stimulation of oil production from a well.

Current techniques for cleaning or stimulating an oil well include the injection of various well known solvents and acids into the production zone of a well. The solvents or acids cause the asphaltenes in the zone to break up and flow through the perforations in the slotted well casing. The solvents or acids also dissolve or dilute contaminants such as scale, bitumen, sediment and the like which may be plugging the casing slots thereby allowing oil in the production zone to more readily flow into the casing and eventually be brought to the surface.

Recently a cleaning technique has been employed which utilized a cleaning device generating a high pressure gas pulse downhole in the region of the casing slots. A flexible tubing encasing a gas generating propellant is run into the perforated section of the casing on a single conductor cable. The propellant is ignited by means of an ignition mechanism thereby producing a gas to propel, high velocity, short duration flow of well fluid and gas through the perforations. This is followed by cooling and contraction of the gas which creates an implosion and flow of fluids into the well bore from the annulus, gravel pock or formation. Thus a double acting outflow-inflow is used to clean the perforations and create flow channels in the annulus. It must be understood that a series of pulses may not be created as the device is withdrawn from the production zone, since there is only a single length of propellant which is ignited.

It is well known in the seismic exploration for hydrocarbons and minerals, oceanographic research, deep earth crustal studies, and well velocity surveys that powerful energy sources may be utilized to create waveforms for mapping purposes. One of these sources is known by the trademark BOLT PAR AIR GUN. Such guns are available in over twenty variations of seven basic models for use at sea and on land, both downhole and on the surface. The guns operate by the principle of the sudden release of high pressure compressed gas, such as air or nitrogen, when electrically fired. A high degree of repeatability may be obtained, allowing the use of multi-gun arrays to achieve high energy output and optimally synthesized waveforms. Such guns have not been used to stimulate producing wells or to clean casing perforations by combining the acoustic pressure pulse with simultaneous injection of solvents or acids into the production zone.

SUMMARY OF THE INVENTION

The present invention provides an apparatus and method for stimulating the production zone of an oil well. The apparatus combines a high pressure air gun adapted to provide a sudden release of high pressure compressed gas when electrically fired within the production zone with a coil tubing conduit connected at a distal end to the gun. The conduit serves as a housing for the high pressure compressed gas supply line attached to the gun and the electrical power transmission line attached to the gun. The conduit further serves as the delivery line for a liquid such as solvent or acid or even water which is injected into the well bore at or near the proximity of the gun. The liquid provides a cooling purpose for the transmission line and the gun when these are used in well bores having high ambient temperatures.

The method of the present invention involves the steps of inserting the apparatus into the production zone, injecting a liquid into the zone at or near the gun through the coil tubing conduit, and firing the gun to stimulate the production zone. The apparatus is gradually withdrawn from the producing zone while the gun is repeatedly fired and liquid is injected. The liquid may be solvent, acid, or even water which not only serves to provide a cleaning or diluting function, but also cools the transmission line and the gun.

DETAILED DESCRIPTION OF THE PREFERRED EMBODIMENT

Figure 1:
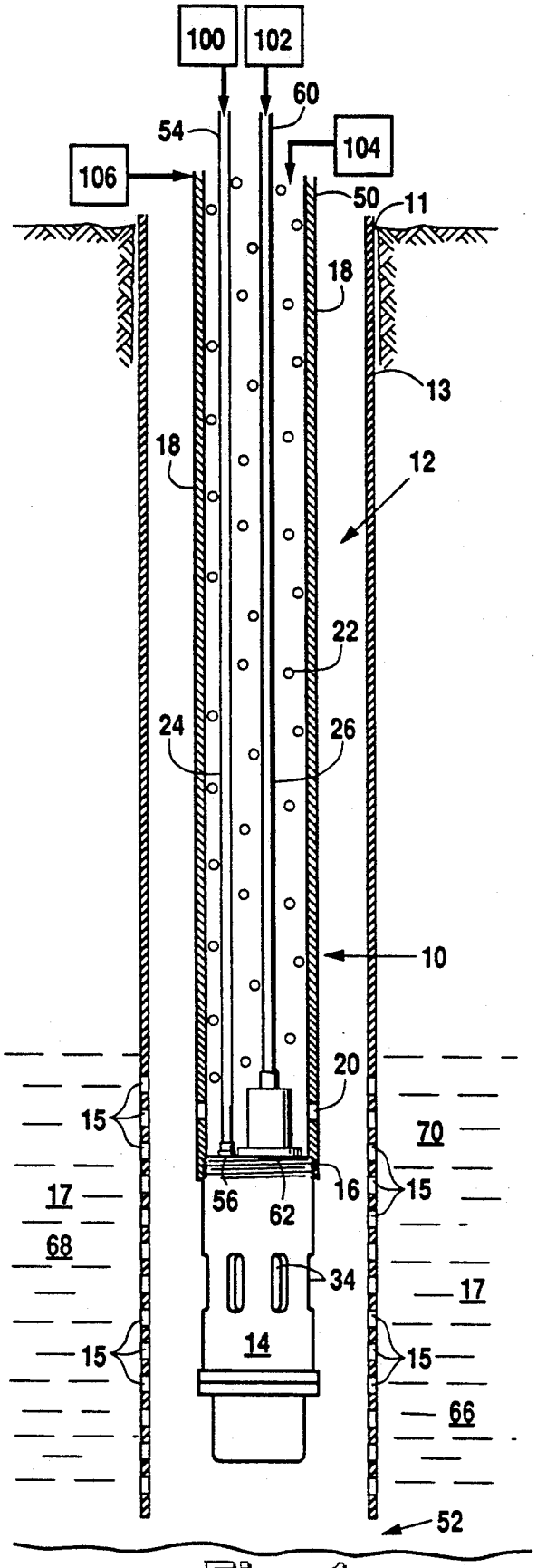
FIG. 1 illustrates a partial cross-sectional view of the present invention downhole in an oil well.

FIG. 1 illustrates a partial cross-sectional view of the present invention 10 downhole in an oil well 12 having a well casing 13 with perforation 15 positioned in a production zone 17. A high pressure gas gun 14, as will be described more fully below, is attached to the distal end 16 of a length of coiled tubing 18. Preferably the gun 14 is threadingly attached to the coil tubing 18, but any suitable means of releasable attachment may be used.

Steel coiled tubing 18 is a small diameter tube in the range of ½" to 2" OD. The typical size used is 1¼" to 2". The tubing nominal inside area is 0.298 to 2.49 square inches. The wall thickness of the tubing is from 0.062" to 0.151". Coil tubing 18 may be inserted and withdrawn from the well head by a method and apparatus known as a coil tubing injector more fully described in U.S. Pat. No. 4,673,035, which is incorporated herein by reference.

The distal end 16 of tubing or conduit 18 is provided with a plurality of discharge ports 20 which are sized to allow for the discharge of liquid 22 at or near the proximity of gun 14. The liquid may be any well known oil well cleaning solvent, chemical, acid, or even water. As will be noted below, the liquid is supplied from a liquid source 104 at the well head 11 and is pumped through tubing or conduit 18 into the production zone 17.

High pressure gas gun 14 is releasably connected to a high pressure gas supply conduit 24 and an electrical power transmission line 26. A typical gas gun is the trademark BOLT PAR AIR GUN well known in the field. Other equivalent gas guns may be used.

Figure 2:
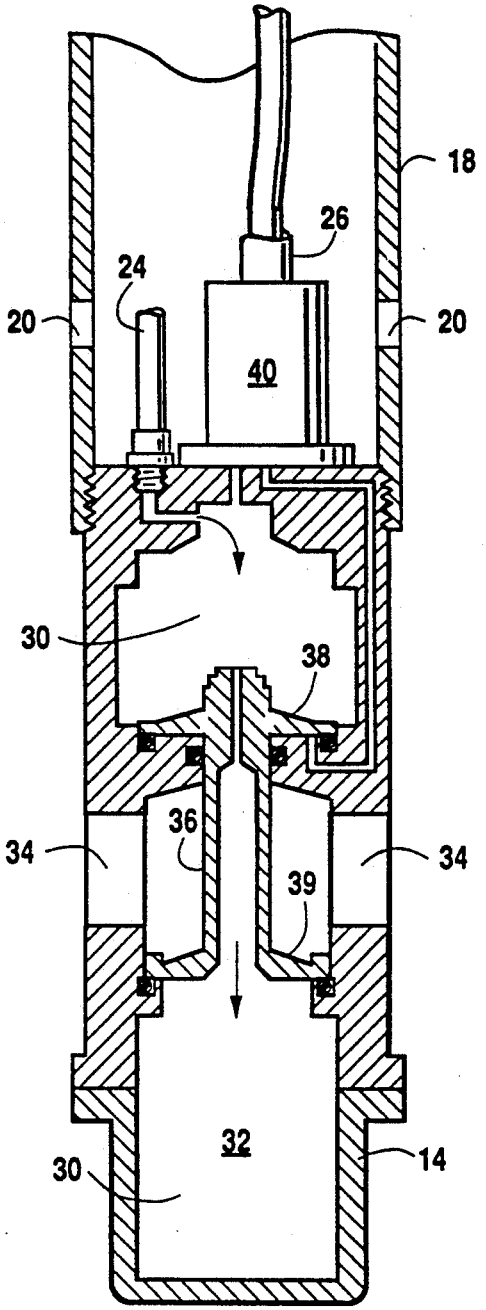
FIG. 2 is an elevational, cross-sectional view of the air gun of the present invention in the armed condition.
Figure 3:
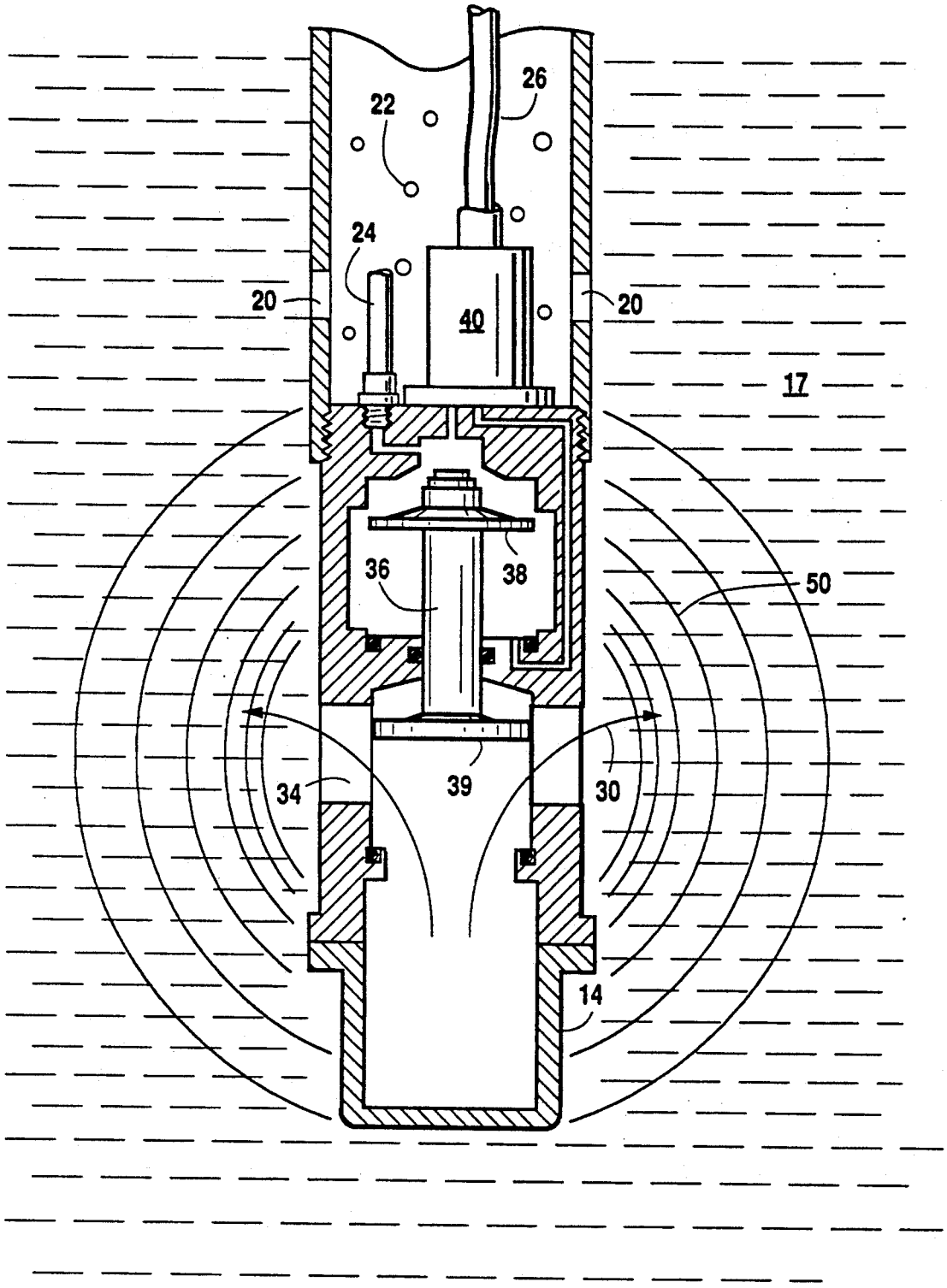
FIG. 3 is an elevational, cross-sectional view of the air gun of the present invention in the fired condition.

FIGS. 2 and 3 illustrate that the gun 14, by the explosive release of high pressure gas 30 directly into the surrounding medium (the production zone 17), provides an acoustic output 50 with a high energy yield. The high pressure gas 30 is stored in a firing chamber 32 and explosively released through portholes 34 through the action of a shuttle 36 with pistons (triggering piston) 38 and (firing piston) 39 at each end. FIG. 2 shows the gun in the armed condition with the shuttle 36 seated and the firing chamber 32 sealed. FIG. 3 shows the solenoid valve 40 has unseated the shuttle 36 to release the stored gas. The solenoid valve 40 is actuated by the supply of electrical power from power source 102 via transmission line 26.

A feature of the operation of the gun 14 is the acceleration of the firing piston 39 before the air is released. By the time this piston 39 reaches the ports 34, it is traveling at a very high speed so that the gas is released explosively. The rise time of the pressure pulse is less than one millisecond for smaller guns and less than five milliseconds for larger ones. Chamber volumes range from 0.5–1,000 cubic inches or greater and operating pressures range from 200 to 5,000 psi.

High pressure gas is provided at the well head by high pressure gas source 100 such as a compressor driven by electric motor or diesel or gasoline engine or hydraulic motor.

Turning to FIG. 1, it may be seen that a length of hollow coil tubing 18 sufficient to extend from a proximal end 50 above the well head 11 of the oil well 12 to a distal end 16 at a bottom 52 of the production zone 17 is inserted into the well. A coiled tubing injector apparatus 106 acts upon the tubing 18 to insert the tubing length into the oil well. The tubing 18 has a multiplicity of fluid discharge ports 20 spaced around the distal end 16 of the tubing 18. Next, inside of the tubing 18 is inserted sufficient length of compressed gas source conduit 24 to extend from a proximal end 54 releasably connected to a high pressure gas source 100 at the well head 11 to a distal end 56 at the distal end 16 of the tubing 18.

A sufficient length of power transmission line 26 to extend from a proximal end 60 releasably connected to an electrical power transmission source 102 at the well head 11 to a distal end 62 at the distal end 16 of the tubing 18 is next inserted inside of tubing 18.

In the present inventive method, the tubing 18, conduit 24 and transmission line 26 are withdrawn from the well head as a three-part unit retaining the conduit 24 and transmission line 26 inside the coil tubing 18. This withdrawal may be achieved by an injector 106 such as that of the method and apparatus disclosed in U.S. Pat. No. 4,673,035, which is incorporated by reference, or any equivalent thereof acting upon tubing 18.

After the unit has been withdrawn, the high pressure gas gun 14 is attached to the distal end 56 of the compressed gas conduit 24 and the distal end 62 of the transmission line 26. The gun 14 is further attached to the distal end 16 of the tubing 18 so that it may be fired when activated by electrical power source 102.

The unit of tubing 18, conduit 24, transmission line 26, and attached gun 14 are reinserted or re-run into the well to the production zone 17 to a first depth 66 by injector 106.

A liquid source 104 is attached to the proximal end 50 of the tubing 18 for injecting liquid 22 (such as solvent, acid, or water) through the tubing 18, around the transmission line 26 and conduit 24 and discharging out through ports 20. Liquid 22 is then injected into the well 12 at the production zone 17.

The gas gun 14 is periodically fired by activation of the electrical source 102 at given time intervals (such as every 5–20 seconds) while the unit with attached gun is gradually withdrawn through the production zone 17 past depths 68 and 70 and on out of the production zone.

In this process, the production zone is stimulated by the acoustic pulse 50 generated and the liquid turbulence created in the production zone. The chemical solvent or liquid 22 reacts within the production zone to increase oil flow from the production zone through perforations 15 in the casing.

It may be understood that the liquid 22 provides not only a stimulating function, but also may provide a cooling function for the transmission line and gun when they are used in wells where there may be steam or other sources of high ambient temperatures. The liquid cooling improves the overall operation of the apparatus and provides for longer life to the apparatus.

While the invention has been described in connection with a preferred embodiment, it is not intended to limit the invention to the particular form set forth, but, on the contrary, it is intended to cover alternatives, modifications, and equivalents, as may be included within the spirit and scope of the invention as defined by the appended claims.

I claim:

1. An apparatus for stimulating the production zone of an oil well comprising:

a high pressure gas gun adapted to provide sudden release of high pressure compressed gas when electrically fired within said production zone;

a coil tubing conduit connected at a distal end to said gun, said conduit housing a high pressure compressed gas supply line attached to said gun and an electrical power transmission line attached to said gun, said conduit adapted to deliver a liquid in proximity to said gun.

2. The apparatus of claim 1 wherein said liquid is a coolant liquid for said transmission line and said gun.

3. The apparatus of claim 1 wherein said liquid is a chemical solvent adapted to react within said production zone to increase oil flow from said production zone.

4. An apparatus for stimulating the production zone of an oil well comprising:

a length of hollow coil tubing sufficient to extend from a proximal end above a well head of said oil well to a distal end at a bottom of said production zone of said oil well, said distal end having fluid discharge ports;

a high pressure compressed gas source conduit inside said coil tubing and extending from a high pressure gas source at said well head to a distal end at said distal end of coil tubing;

an electrical power transmission line inside said coil tubing and extending from an electrical power source at said well head to a distal end at said distal end of said coil tubing;

a high pressure gas gun adapted to provide sudden release of high pressure compressed gas when electrically fired, said gas gun releasably connected to said distal end of said coil tubing to said distal end of said gas source conduit, and to said distal end of said transmission line;

a liquid source releasably attached to said proximal end of said coil tubing and adapted to provide fluid for injection into said production zone by discharge through said fluid discharge ports in said distal end of said coil tubing; and a means for inserting and withdrawing said length of said tubing, said air source conduit, said transmission line, said air gun, into and from said production zone, said injecting and withdrawing means positionable at said well head.

5. Method for stimulating the production zone of an oil well comprising the steps of:

inserting into said production zone to first depth a high pressure gas gun adapted to provide sudden release of high pressure compressed gas when electrically fired;

injecting into said production zone a well cleaning solvent while firing said high pressure gas gun;

gradually withdrawing said gun through said production zone while periodically firing said gun to thereby stimulate said production zone of said oil well.

6. Method for stimulating the production zone of an oil well comprising the steps of:

a. inserting a length of hollow tubing sufficient to extend from a proximal end above a well head of said oil well to a distal end at a bottom of said production zone, said distal end having a plurality of fluid discharge ports;

b. inserting inside said tubing sufficient length of high pressure compressed gas source conduit to extend from a proximal end releasably connected to a high pressure gas source at said well head to a distal end at said distal end of said tubing;

c. inserting inside said tubing sufficient length of an electrical power transmission line to extend from a proximal end releasably connected to an electrical power transmission source at said well head to a distal end at said distal end of said tubing;

d. withdrawing said tubing, said conduit, and said transmission line as unit from said oil well thereby retaining said conduit and said transmission line inside said tubing;

e. attaching a high pressure gas gun to said distal end of said transmission line to said distal end of said conduit, and to said distal end of said tubing, said gas gun adapted to provide sudden release of high pressure compressed gas supplied through said conduit when said gun is electrically fired;

f. reinserting said unit of tubing, conduit, and transmission line and said attached air gun into said producing zone of said well to a first depth;

g. attaching a liquid source to said proximal end of said tubing for injecting liquid through said tubing, around said conduit and said transmission line, and discharging through said liquid discharge ports;

h. injecting liquid into said production zone from said liquid source; and i. periodically firing said gas gun by activation of said electrical power source at given time intervals while gradually withdrawing said unit of tubing, conduit, and transmission line with said attached gas gun through said production zone thereby stimulating said production zone of said oil well.

7. The method of claim 6 wherein said liquid is a coolant liquid for said transmission line and said gun.

8. The method of claim 6 wherein said liquid is a chemical solvent adapted to react within said production zone to increase oil flow from said production zone.

* * * * *